United States Patent [19]

Mizelle

[11] 4,236,752

[45] Dec. 2, 1980

[54] ROCKER SWIVEL ASSEMBLY FOR CHAIRS

[75] Inventor: Ned W. Mizelle, Lexington, Ky.

[73] Assignee: Hoover Universal, Inc., Saline, Mich.

[21] Appl. No.: 36,072

[22] Filed: May 4, 1979

[51] Int. Cl.[3] ..... A47C 3/18

[52] U.S. Cl. ..... 297/303; 297/268; 248/608

[58] Field of Search ..... 297/263, 264, 268, 302, 297/303; 248/608, 609

[56] References Cited

U.S. PATENT DOCUMENTS

| | | | |
|---|---|---|---|
| 1,732,646 | 10/1929 | Flintermann | 248/609 |
| 3,544,159 | 12/1970 | Andersson | 297/303 |
| 3,826,456 | 7/1974 | Tranter et al. | 297/303 |

FOREIGN PATENT DOCUMENTS

| | | | |
|---|---|---|---|
| 661070 | 11/1951 | United Kingdom | 248/608 |

*Primary Examiner*—Francis K. Zugel

*Attorney, Agent, or Firm*—Olsen and Stpehenson

[57] ABSTRACT

A rocker swivel assembly for mounting a chair on a lower support for both rocking and swiveling movement of the chair. The assembly includes a one-piece plastic torsion bar unit having a center section and a pair of end sections. The end sections are secured to the underside of the chair and the center section is rotatably mounted on the chair support and restrained against twisting. When the chair is rocked, the end portions of the torsion bar are twisted and the direct seating load of the chair is at all times transmitted directly to the supported center section of the torsion bar by a load bearig member secured to the underside of the chair and slidably engaged with the top side of the center section of the torsion bar.

10 Claims, 14 Drawing Figures

Fig-1
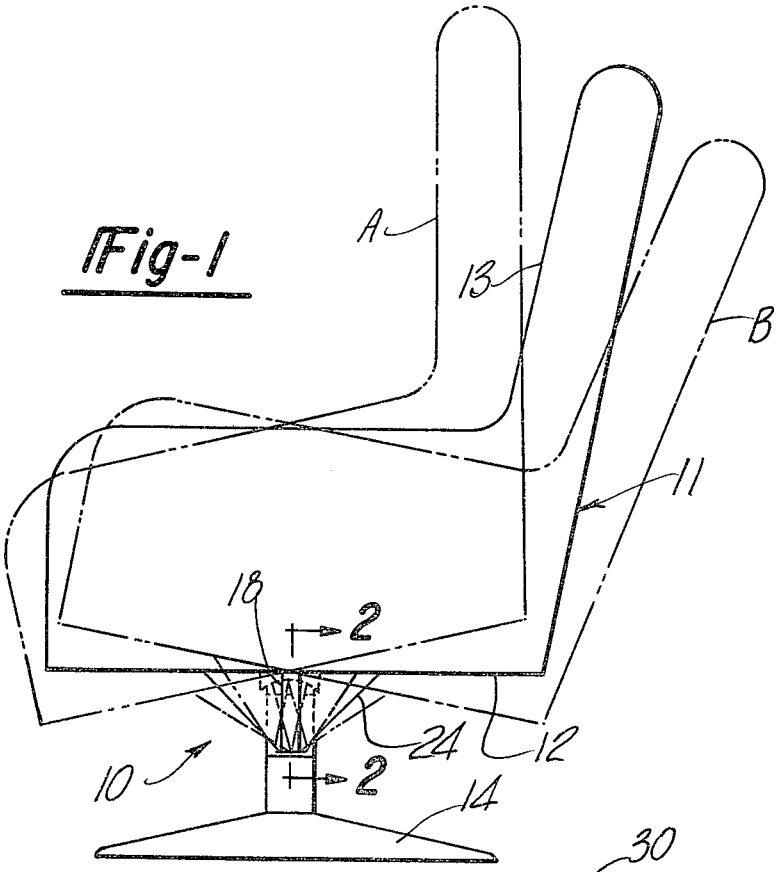
Fig-2
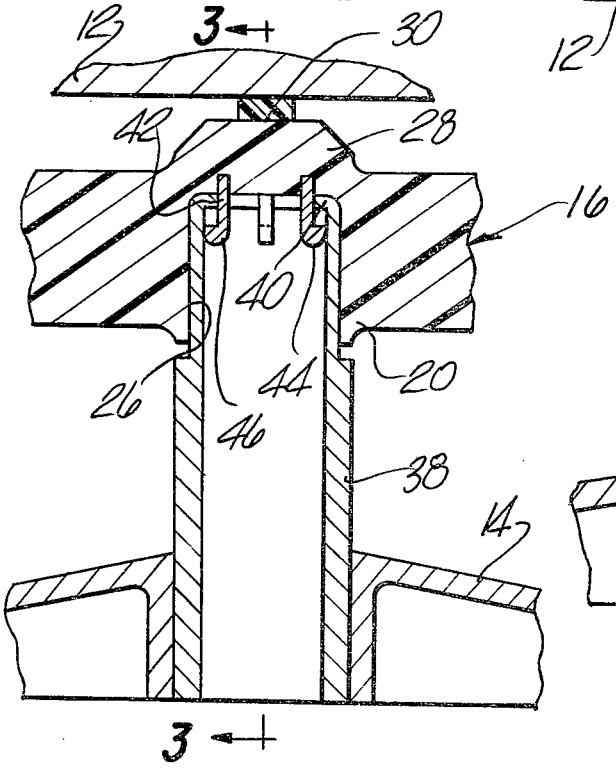
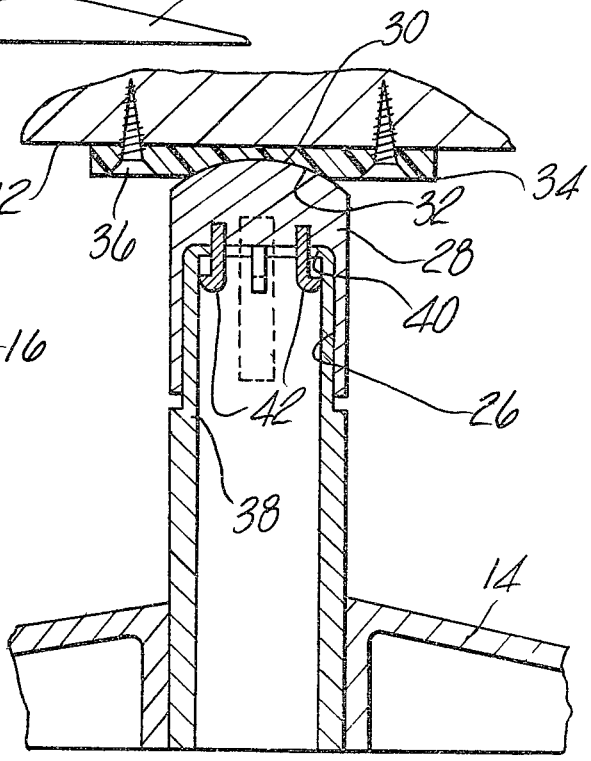
Fig-3

ROCKER SWIVEL ASSEMBLY FOR CHAIRS

BACKGROUND OF THE INVENTION

Furniture chairs which can be both rocked and swiveled have long been considered to be a desirable form of seating. U.S. Pat. No. 3,053,570 illustrates a rocker fixture for this purpose which is believed to be representative of a common type of fixture used in chairs of this type. These fixtures employ rocker members secured to the underside of the chair seat and supported on a swivel plate with a plurality of spiral springs arranged to resist rocking movement of the rocker members on the swivel plate. These fixtures are satisfactory for their intended purpose and are used in substantial numbers. However, by virtue of the number of parts involved, particularly the heavy spiral springs, the fixtures require substantial assembly time and are subject to fatigue failure at any one of a number of points.

Also, it is known to use torsion bars in chair rockers to yieldably resist rocking movement of the chair seat. Such a structure is illustrated in U.S. Pat. No. 2,334,618.

The present invention provides an improved rocker swivel assembly in which a torsion bar unit is employed to yieldably resist rocking movement of the chair, and, in addition, the torsion bar is employed to resist downwardly directed seating loads and as a component in the swivel assembly. The result is a structure which enables the desired rocking and swiveling movement of a chair without the complexities and structural weaknesses heretofore found in prior art structures.

SUMMARY OF THE INVENTION

The rocker swivel assembly of this invention has as its principal component a one-piece plastic molded torsion bar which is secured at its ends to the underside of the chair seat and is supported intermediate its ends on the chair support disposed below the seat. The center section of the torsion bar is restrained against twisting and is swivelly mounted on the support so as to provide the desired swiveling action. The upper side of the center section of the torsion bar provides a direct bearing support for the chair so that an efficient resistance to column type loads is incorporated in the torsion bar assembly.

The torsion bar can be either tubular or rectangular in cross section and forms of the invention are illustrated utilizing many cross sectional shapes.

The result is a rocker swivel assembly consisting of relatively few parts which can be readily fabricated and assembled with a support and a chair seat so as to provide the desired rocking and swiveling motion for the chair.

Further objects, features, and advantages of the invention will become apparent from a consideration of the following description and the appended claims, when taken in connection with the accompanying drawing, in which:

FIG. 1 is a side elevational view of a chair equipped with the rocker swivel assembly of this invention and illustrating the chair in a straight-up seating position in solid lines and in rocked positions in broken lines;

FIG. 2 is an enlarged fragmentary transverse sectional view of the rocker swivel assembly of this invention as seen from substantially the line 2—2 in FIG. 1;

FIG. 3 is a transverse sectional view of the rocker swivel assembly of this invention as seen from substantially the line 3—3 in FIG. 2;

Figure 10:
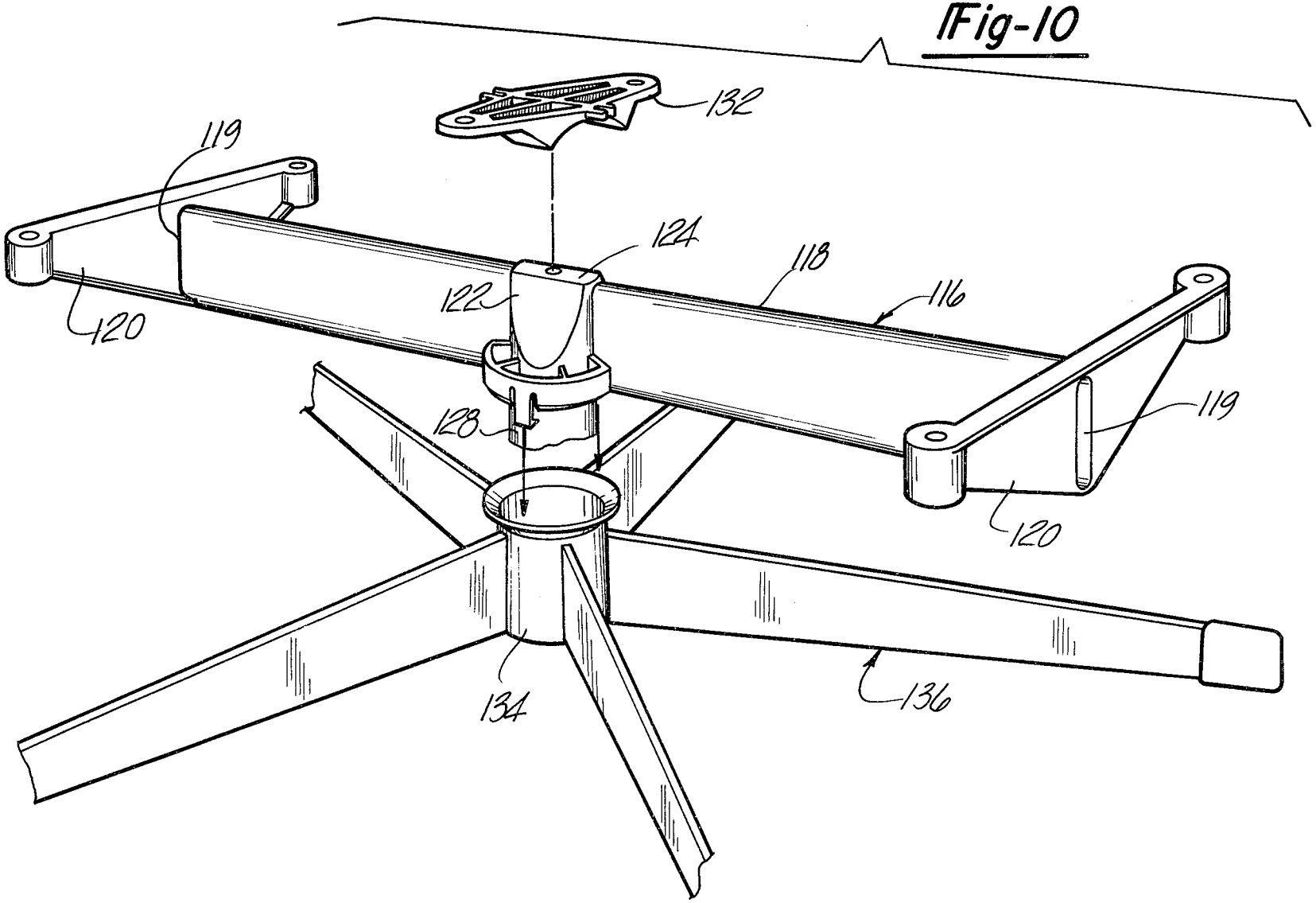
FIG. 10 is an exploded perspective view of still another modified form of torsion bar unit in the rocker swivel assembly of this invention and a supporting base therefor.
Figures 11, 12, 13, 14:
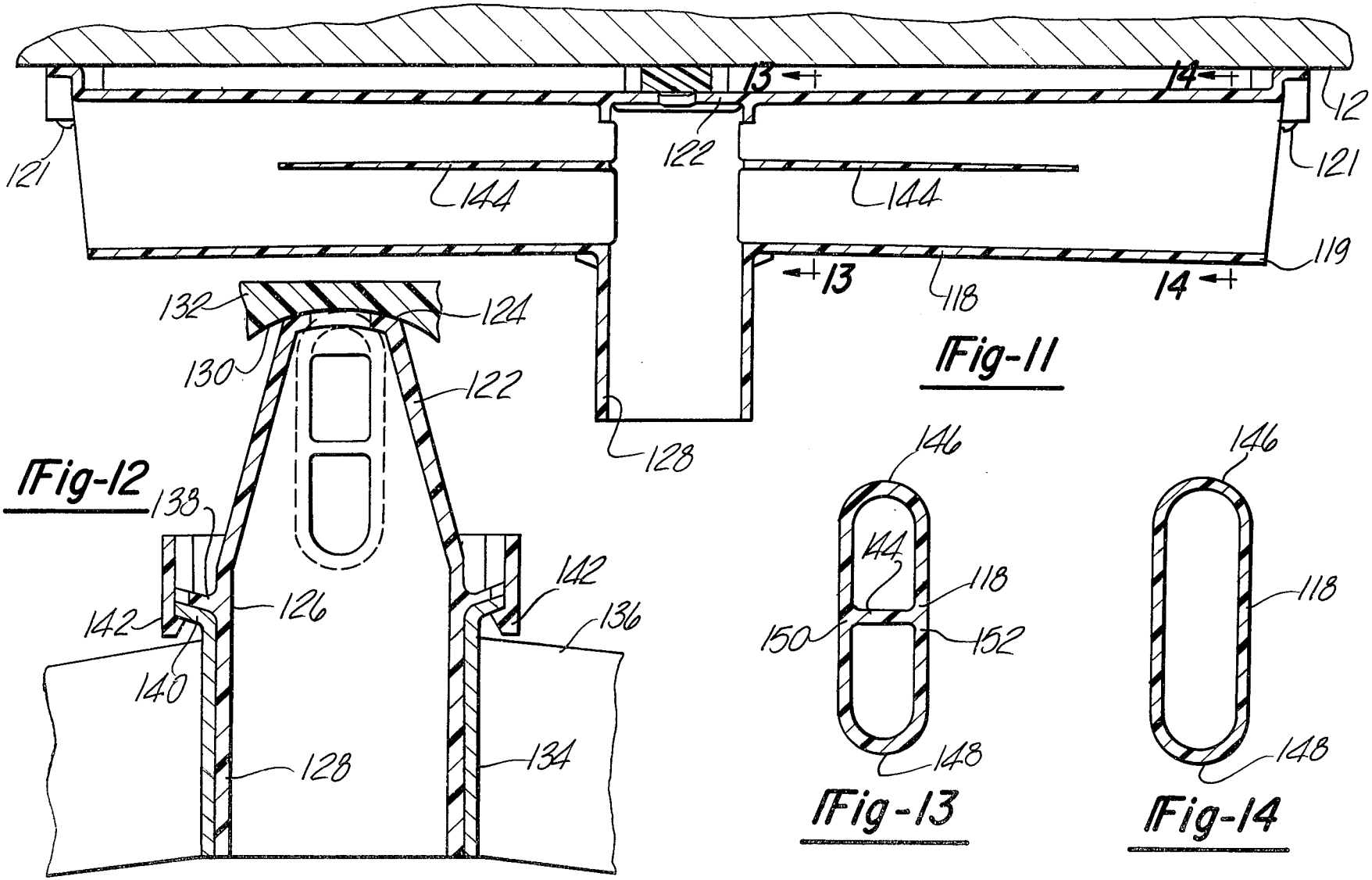
FIG. 11 is a front elevational view of the torsion bar unit shown in FIG. 10, showing the unit secured to the underside of a chair seat.

FIG. 12 is an enlarged transverse sectional view of the torsion bar unit shown in FIG. 10; and FIGS. 13 and 14 are enlarged sectional views of the modified torsion bar unit of this invention as seen from lines 13—13 and 14—14, respectively, in FIG. 11.

With reference to the drawing, the rocker swivel assembly of this invention, indicated generally at 10, is illustrated in FIG. 1 in assembly relation with a chair 11 having a seat 12 and a back 13 and supported on a base 14. The assembly 10 includes a one piece torsion bar unit 16 (FIG. 4) having a pair of end sections 18 and a center section 20. In the form of the invention illustrated in FIG. 4, the end sections 18 are generally rectangular in cross sectional shape and the center section 20, which functions to resist column-like loads, is of an enlarged size relative to the end sections 18.

Figure 4:
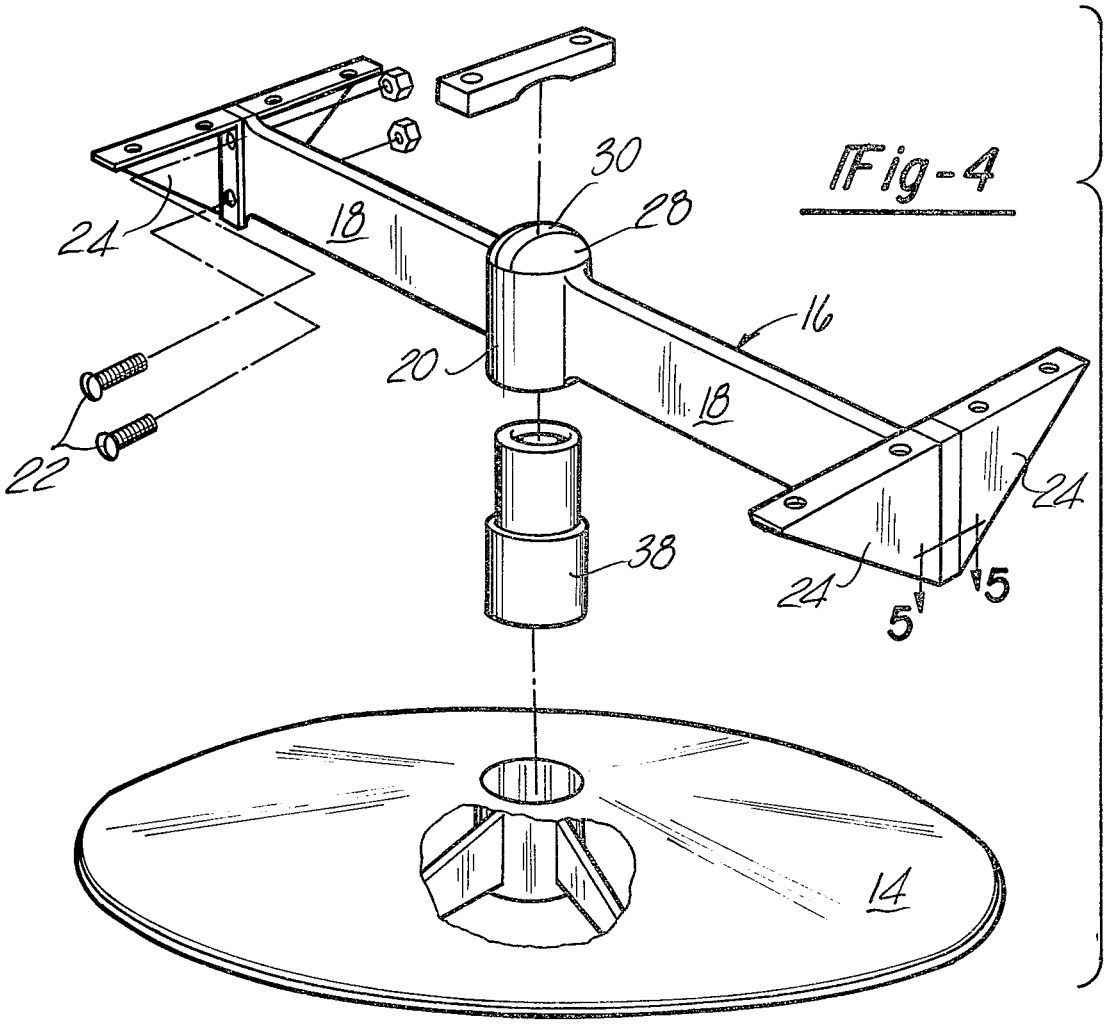
FIG. 4 is an exploded perspective view of the rocker swivel assembly of this invention.
Figure 5:
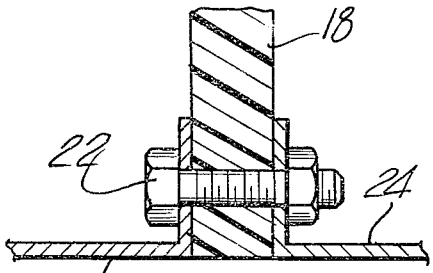
FIG. 5 is an enlarged fragmentary detailed view of the assembly of this invention as seen from substantially line 5—5 in FIG. 4.

Each end section 18 is secured, such as by bolts 22 to end brackets 24 which are in turn secured to the underside of the chair seat 12, as shown in FIGS. 1 and 4. The center section 20 has a downwardly opening cylindrical cavity 26 (FIG. 2) formed in it so that it is of generally tubular shape having an upwardly projecting solid upper end 28 that terminates in an arcuate bearing surface 30. The surface 30 is engaged by a similarly shaped arcuate surface 32 formed on a bearing plate 34 secured by screws 36 to the underside of the chair seat 12 (FIGS. 2 and 3).

The chair base 14 has an upwardly projecting tubular column 38 secured to it which is formed at its upper end with an inturned annular flange 40. The column 38 is of a size to telescope into the cylindrical cavity 26 in the torsion bar center section 20. Downwardly extending latch members 42 carried by the torsion bar center section 20 have cam shape lower end surfaces 44 which cause the latch members to cam inwardly over the flange 40 during insertion of the column 38 into the cylindrical cavity 26. The surfaces 44 are formed on enlarged heads 46 provided at the lower ends of the latch members 42 and after the heads 46 pass over the flange 40, during insertion of the column 38 in the cavity 26, the latch members 42 snap to the position shown in FIG. 2 in which the heads 46 are engageable with the flange 42 to prevent disassembly of the column 38 and the torsion bar center section 20 from their relatively telescoped positions shown in FIGS. 2 and 3.

In the use of the rocker swivel assembly 10 of this invention, downwardly directed column-type seating loads are transferred from the chair seat 12 directly to the torsion bar center section 20 through the bearing plate 34. This transfer takes place both during rocking movement of the chair 11 and when the chair 11 is being swiveled or maintained in a stationary position without rocking. During swiveling of the chair 11, the torsion bar center section 20 swivels directly on the upper end of the column 38 and the one piece plastic construction of the torsion bar unit 16 facilitates this swiveling movement because plastics that have the requisite strength to form the torsion bar unit 16 also have relatively low coefficients of friction thus facilitating relative swiveling movement of the torsion bar unit 16 and the base column 38.

During rocking movement of chair 11, the bearing plate 34 moves freely on the arcuate bearing surface 30 on the upper end of the torsion bar center section 20 and the end sections 18 of the torsion bar unit 16 are twisted relative to the center section 20. This is shown best in FIG. 1 which shows that the end sections 18 are twisted in a counterclockwise direction during forward rocking of the chair 11 to its position shown at A in broken lines in FIG. 1, and the torsion bar end sections 18 are twisted in a clockwise direction during backward rocking movement of the chair 13 from its upright position to its position shown at B in FIG. 1. During this movement, the center section 20 of the torsion bar unit 16 is maintained in a fixed position and restrained against any twisting movement by the column 38. The resilient ability of the torsion bar unit 16 to un-twist itself and return to an untwisted position facilitates rocking movement of the chair 11.

Figure 6:
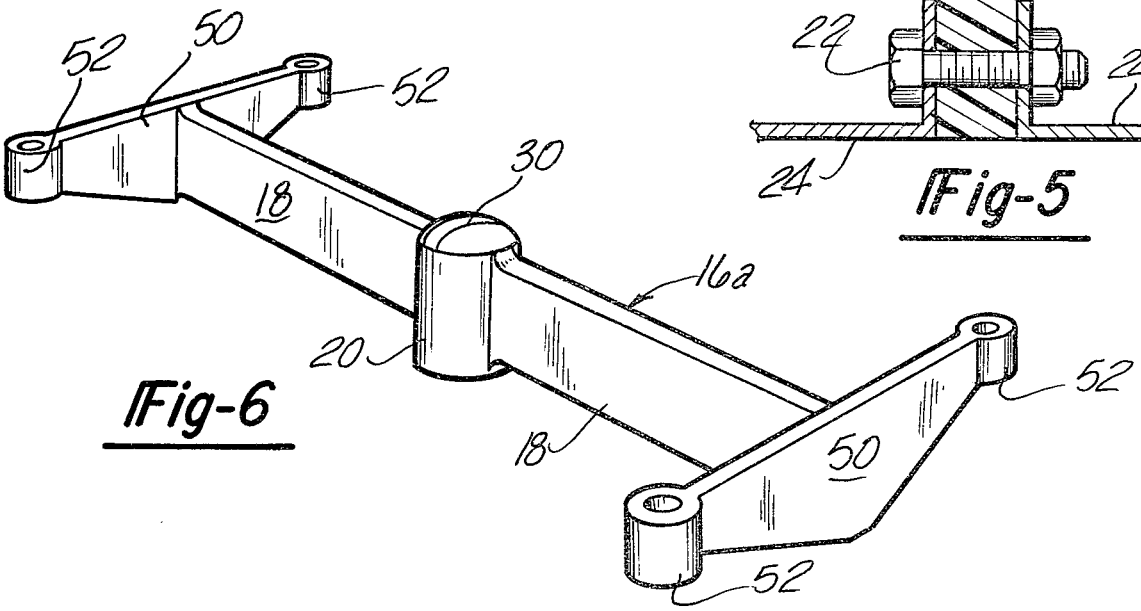
FIG. 6 is a perspective view of a modified form of the torsion bar unit which is the principal component in the rocker swivel assembly of this invention.

A modified form of the torsion bar unit 16 is illustrated in FIG. 6 and indicated generally at 16*a*. The unit 16*a* is identical to the unit 16 except that it does not require the brackets 24 for attaching it to the underside of the chair seat 12 since it is integrally formed with transversely extending end sections 50 which are provided with tubular bosses 52 through which screws (not shown) can be extended to secure the end sections 50 of the one piece unit 16*a* directly to the underside of the chair seat 12. In all other respects, the unit 16*a* identical to the unit 16 and like numerals are therefore used in FIG. 6 to indicate parts of the unit 16*a* that are like the correspondingly numbered parts in the unit 16.

Figure 7:
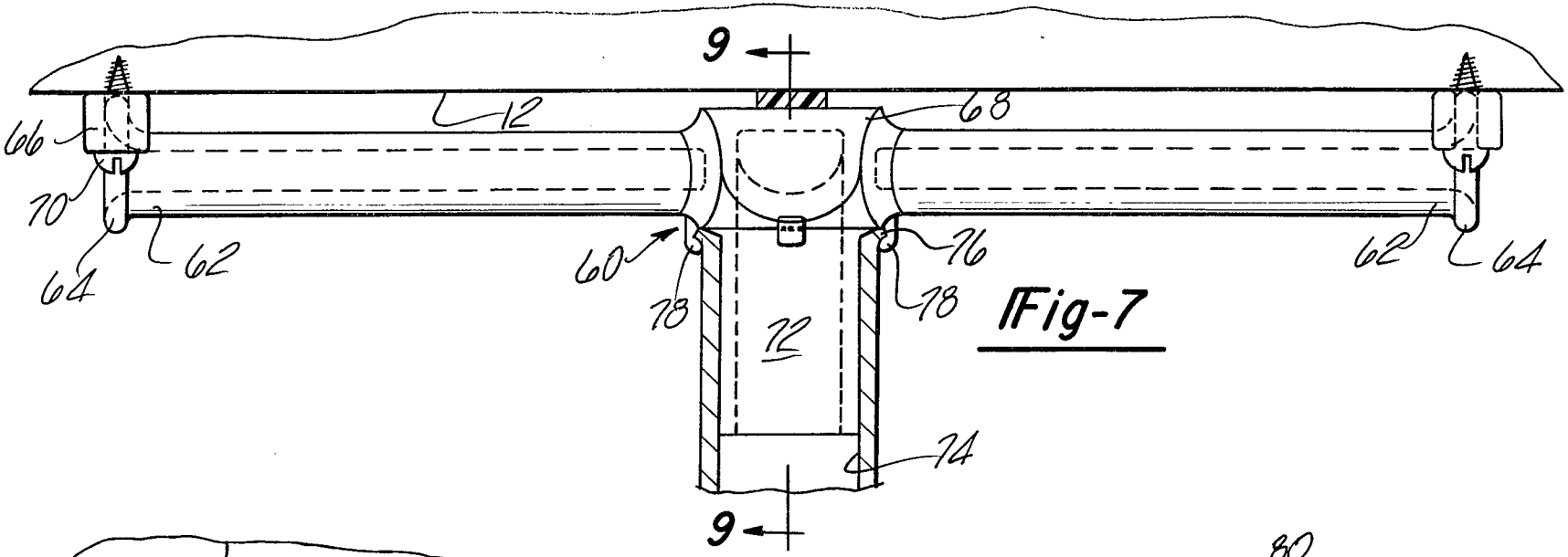
FIG. 7 is a fragmentary front elevational view of another modified form of torsion bar unit in the rocker swivel assembly of this invention showing the torsion bar unit in assembly relation with a chair seat and a chair support.

Still another modified form of the torsion bar unit 16 is illustrated in FIG. 7 and indicated generally by the numeral 60. The unit 60 has tubular end sections 62 that are integrally formed at their terminal ends with transverse projections 64 that terminate in tubular bosses 66. The unit 60 also has an enlarged center section 68. Screws 70 are extended through the tubular bosses 66 to secure the ends of the torsion bar unit 60 to the underside of the chair seat 12, as shown in FIG. 7. The center section 68 is integrally formed with a downwardly extending tubular projection 72 which is of a size to telescope within the upper end of a column 74, like the column 38 that was previously described, which is formed at its upper end with an out turned flange 76. Snap latch members 78 on the center section 68 snap over the flange 76 when the tubular projection 72 is telescoped within the column 74 to the position shown in FIG. 7 in which the torsion bar unit 60 is assembled with the base-supported column 74.

Figure 9:
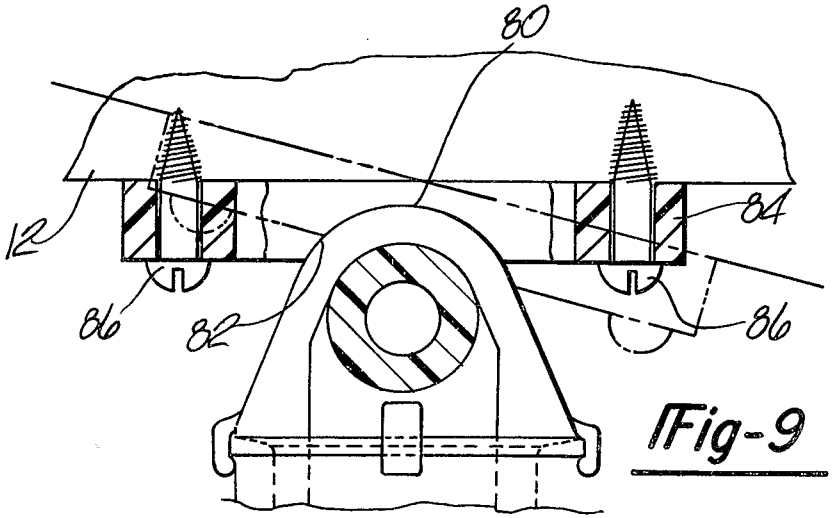
FIG. 9 is an enlarged fragmentary elevational view of the structure shown in FIG. 7, as viewed from substantially the line 9—9 in FIG. 7, showing the bearing plate in broken lines in a rocked position.
Figure 8:
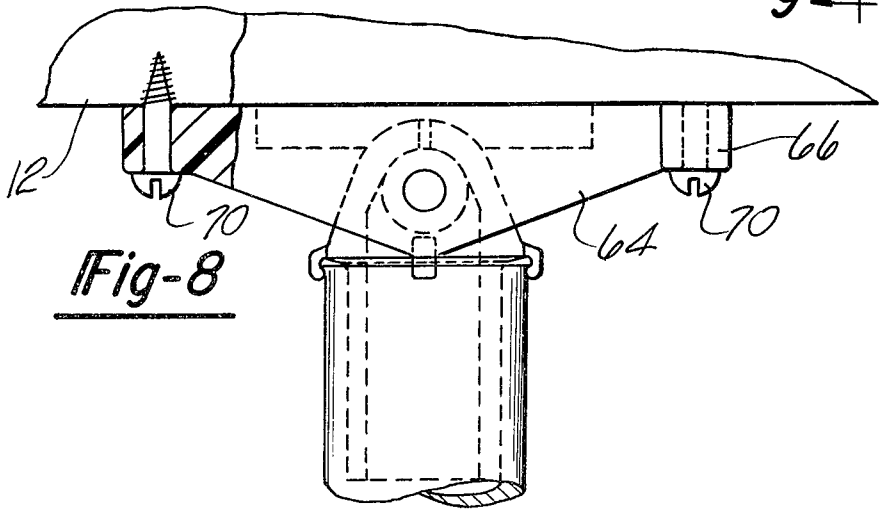
FIG. 8 is a fragmentary side elevational view of the structure illustrated in FIG. 7.

The upper end of the center section 68 is arcuate in shape, as shown at 80 in FIG. 9, and is in engagement with a similarly arcuate shaped surface 82 on a bearing plate 84 secured by screws 86 to the underside of the chair seat 12. Thus, the torsion bar unit 60 operates like the torsion bar unit 16 to resist both downwardly directed column-like loads applied to the upper end surface 80 of the center section 68 through the bearing block 84 and torque loads applied to the torsion bar unit 60 by twisting the end sections 62 relative to the center section 68 when the chair 11 is rocked in either direction from its straight-up seating position shown in solid lines in FIG. 1.

Yet another modified form of the torsion bar unit of this invention is illustrated in FIGS. 10–14, inclusive, and illustrated generally by the numeral 116. The torsion bar unit 116 is comprised of an elongated hollow bar 118 secured at its ends 119 to transverse mounting brackets 120 secured by screws 121 to the bottom of the seat 12 (FIG. 11). The bar 118 has a center section 122 that is reinforced and has an upper arcuate bearing surface 124. The section 122 also has a downwardly opening cylindrical cavity 126 (FIG. 12) that terminates in a downwardly extending tubular projection 128.

The bearing surface 124 is engaged by a similarly shaped arcuate surface 130 formed on a bearing plate 132 secured to the underside of the chair seat 12 (FIGS. 11 and 12). The projection 128 telescopes into a tubular column or support 134 in a chair base 136 to a stop position in which a flange 138 on the projection 128 engages a flange 140 on the support 134. Snap latch members 142 on the bar center section snap over the flange 140 in the stop position of the projection 128 to releasably maintain the chair seat mounted torsion bar unit 116 rotatably mounted on the base 136.

The bar 118 is shaped to efficiently resist seating and rocking loads on the unit 116, while enabling low cost, light weight manufacture of the unit 116. The bar 118 has a gradually decreasing wall thickness from the center section 122 to the ends 119, and also has horizontal reinforcing webs 144 which extend more than half way from the center section 122 to the ends 119, each web 144 being of decreasing thickness and being located about midway between the rounded top and bottom surfaces 146 and 148, respectively, of the bar 118. As shown in FIGS. 13 and 14, the bar 118 is more than twice as deep in a vertical direction as it is wide in a horizontal direction and has flat generally parallel side walls 150 and 152. The bar 118 is also tapered outwardly from its center 122 to its ends 119, as shown from a comparison of FIGS. 13 and 14, so that it is larger in cross section at its ends 119.

This construction enables the bar 118 to efficiently resist seating and rocking loads on the chair 11 because the increased size of the bar 118 at the ends 119, with the accompanying thin section, improves the flexibility of the bar and the increased material near the center section 122 where the torsional loads are highest enables the bar 118 to resist the resulting stresses. The result is a bar 118 that is lightweight and can be economically produced from a minimum of raw material and will still hold up with continual stressing over a prolonged service life.

From the above description, it is seen that this invention provides a swivel rocker assembly 10 which consists essentially of a torsion bar unit 16, 162, 60, or 116, the upwardly extending column on the chair base and the bearing plate secured to the underside of the chair seat 12 and engaged with the top end of the torsion bar center section. The torsion bar is preferably molded from a plastic material having the requisite structural strength and can be of either the rectangular shape illustrated in FIGS. 4 and 6, the tubular shape illustrated in FIG. 7, or the hollow beam shape shown in FIG. 7. In both cases, the torsion bar unit effectively resists both column-like loads and torque loads over a prolonged service life. The unit 10 thus enables the desired movement of the chair 11 with a structure that is simpler and stronger than the structures heretofore available for such purpose.

What is claimed:

1. In a chair having a seat and a support located below the seat, a rocker swivel assembly operable to mount the seat on the support for both rocking and swiveling movement, said assembly comprising a torsion bar unit having a center section and a pair of end sections, means securing said end sections to the underside of said seat, means rotatably mounting said center section on said support and maintaining said center section against rocking relative to said support, whereby on rocking of said seat relative to said support said end sections of said torsion bar are angularly moved relative to said center section, and bearing means acting directly between said seat and said center section to transfer a portion of the downward seating load directly to said center section.

2. A rocker swivel assembly according to claim 1, wherein said load bearing means and said top side of the center section have arcuate engaging surfaces for transferring seating loads directly to said center section during rocking movement of said seat.

3. A rocker swivel assembly according to claim 1 wherein said torsion bar unit comprises a one piece plastic body of predetermined shape in vertical cross section.

4. A rocker swivel assembly according to claim 3 wherein said predetermined shape is a tubular shape.

5. A rocker swivel assembly according to claim 3 wherein said predetermined shape is a rectangular shape.

6. A rocker swivel assembly according to claim 3 wherein said predetermined shape is a hollow shape having rounded top and bottom surfaces and generally parallel side walls, the distance between said surfaces being substantially greater than the distance between said walls.

7. A rocker swivel assembly according to claim 6 further including reinforcing internal webs in said body adjacent the center section thereof.

8. A rocker swivel assembly according to claim 1 wherein said center section includes a downwardly extending tubular projection arranged in a relatively telescoping relation with said support.

9. A rocker swivel assembly according to claim 6 further including coacting means on said center section and said support releasably maintaining said center section and said support in said relatively telescoping relation.

10. In a chair having a seat and a support located below the seat, a rocker swivel assembly operable to mount the seat on the support for both rocking and swiveling movement, said assembly comprising a torsion bar unit including a one piece plastic body of predetermined hollow shape in vertical cross section, said hollow shaped body having rounded top and bottom surfaces and generally parallel side walls, the distance between said surfaces being substantially greater than the distance between said walls, said body having a center section and a pair of end sections and reinforcing internal webs adjacent the center section thereof, means securing said end sections to the underside of said seat, and means rotatably mounting said center section on said support and maintaining said center section against rocking relative to said support, whereby on rocking of said seat relative to said support said end sections of said torsion bar are angularly moved relative to said center section.

* * * * *